US006793531B1

(12) United States Patent
Zhang

(10) Patent No.: US 6,793,531 B1
(45) Date of Patent: Sep. 21, 2004

(54) SHIELDED ELECTRICAL CONNECTOR

(75) Inventor: Guozeng Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/407,510

(22) Filed: Apr. 4, 2003

(30) Foreign Application Priority Data

Mar. 12, 2003 (TW) ..... 92203737

(51) Int. Cl.[7] ..... H01R 13/648
(52) U.S. Cl. ..... 439/607
(58) Field of Search ..... 439/607–609, 439/108, 101

(56) References Cited

U.S. PATENT DOCUMENTS 6,280,209 B1 8/2001 Bassler et al.
6,447,311 B1 9/2002 Hu et al.
6,482,037 B1 11/2002 Zhu et al.
6,503,102 B1 * 1/2003 Zhang et al. ..... 439/607
6,520,799 B1 * 2/2003 Cheng et al. ..... 439/541.5

* cited by examiner

*Primary Examiner*—Gary Paumen
(74) *Attorney, Agent, or Firm*—Wei Te Chung

(57) ABSTRACT

An electrical connector includes an insulative housing (1), a number of terminals (5) received in the housing, an inner shield (2), an outer shield (3), a spacer (4) and a rear shield (6). The insulative housing includes a base portion (13), a pair of parallel tongues (111,112) extending forwardly from the base portion, and a number of passageways (12) defined in respective tongues for receiving, the terminals. The inner shield substantially encloses the tongues and includes a pair of fingers formed at rear ends thereof. The outer shield encloses both the inner shield and the insulative housing. The rear shield is assembled to the outer shield and electrical contacts with the fingers of the inner shield to thereby establish an electrical connection between the inner and outer shield.

1 Claim, 4 Drawing Sheets

SHIELDED ELECTRICAL CONNECTOR

BACKGROUND OF THE INVENTION

1. Field of the Invention

The present invention generally relates to an electrical connector, and particularly to an electrical connector shielded by a metallic shell thereof 2. Description of Prior Arts With the development of communication and computer technology, electrical connectors for high-speed data transmission are widely used in electronic systems. As the speed of the data transmission increases, Electro Magnetic Interference (EMI) becomes an important issue. Therefore, this type of the connector always comprises a plurality of metallic shields for avoiding the EMI.

U.S. Pat. No. 6,280,209 discloses an electrical connector comprising an inner shield and an outer shield. A grounding plate integrally forms with the inner shield and another grounding plate extends from the outer shield. The grounding plates of the inner shield and the outer shield respectively connect to corresponding grounding pads on a printed circuit board (PCB) so that electrical connections are established between the inner shield and the printed circuit board and the outer shield and the printed circuit board to protect the connector from the Electro Magnetic Interference. However, such arrangement of the electrical connections requires the printed circuit board to define more corresponding grounding pads thereon, which obviously complexes the manufacture of the PCB.

U.S. Pat. No. 6,482,037 discloses another conventional connector which comprises a grounding device received in the insulative housing. The grounding device has an end contacting with the inner shield and has another end contacting with corresponding grounding pad of the PCB. An outer shield has a pair of grounding plates and connects to the corresponding grounding pad of the PCB via the grounding plates, However, the PCB still requires numerous ground pads thereon and the manufacture of the PCB is also complexed.

Hence, it is desirable to have an improved connector to overcome the above-mentioned disadvantages of the prior art.

BRIEF SUMMARY OF THE INVENTION

Accordingly, it is an object of the present invention to provide a connector which simplifies the layout and the manufacture of the PCB to which the connector mounted.

In order to achieve the above-mentioned objects, an electrical connector includes an insulative housing, a plurality of terminals received in the housing, an inner shield, an outer shield, a spacer and a rear shield. The insulative housing includes a base portion, a pair of parallel tongues extending forwardly from the base portion, and a number of passageways defined in respective tongues for receiving the terminals. The inner shield substantially encloses the tongues and includes a pair of fingers formed at rear ends thereof. The outer shield encloses both the inner shield and the insulative housing. The rear shield is assembled to the outer shield and electrical contacts with the fingers of the inner shield to thereby establish an electrical connection between the inner and outer shield.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
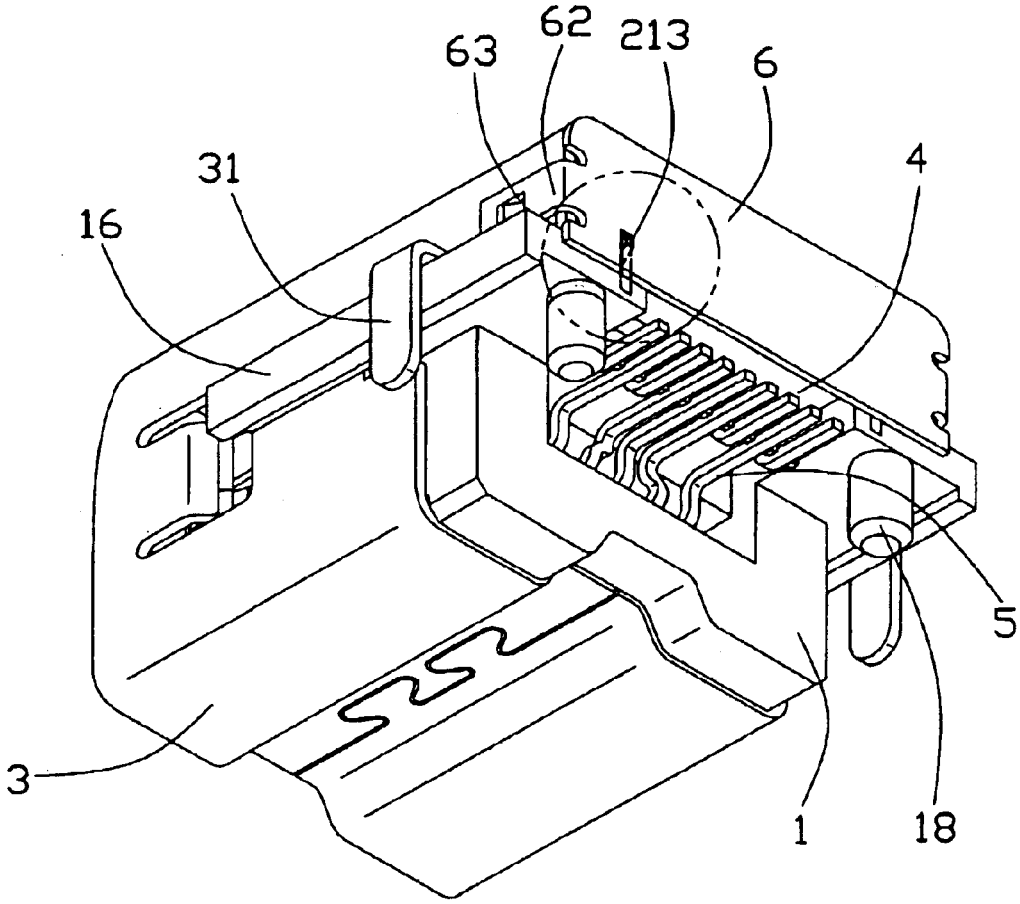
FIG. 1 is a perspective view of an electrical connector in accordance with the present invention.

Reference will now be made to the drawing figures to describe the present invention in detail.

Figure 2:
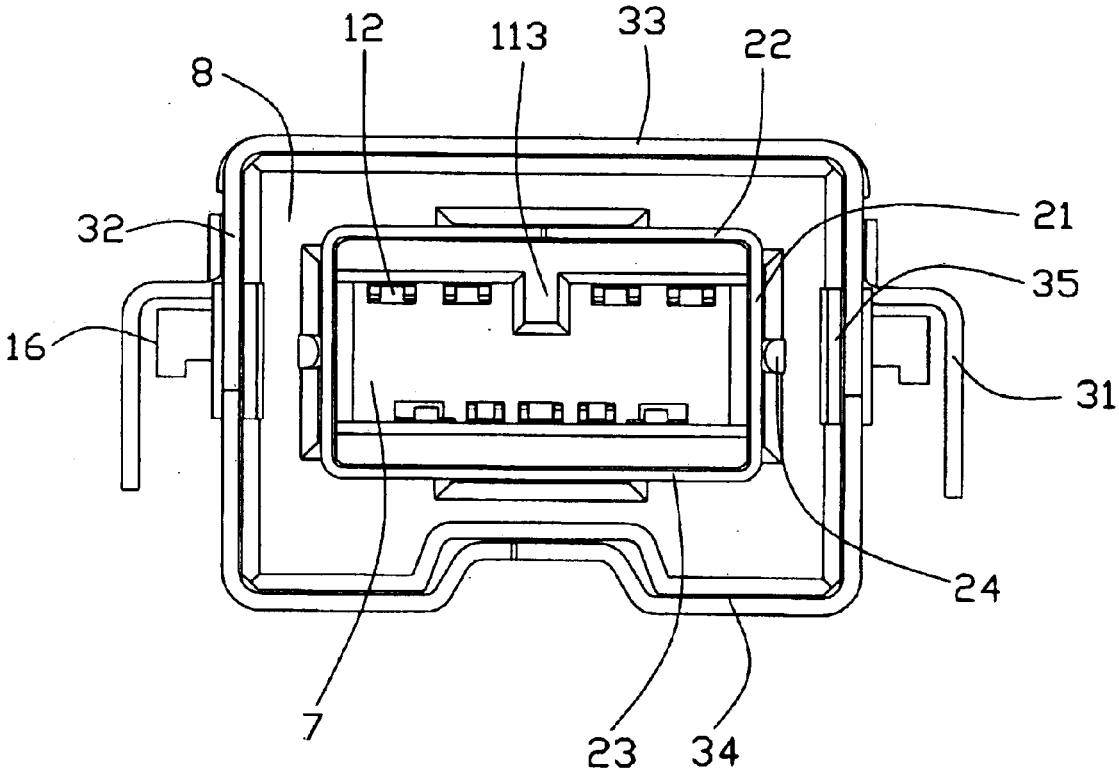
FIG. 2 is a front view of the electrical connector shown in FIG. 1.
Figure 3:
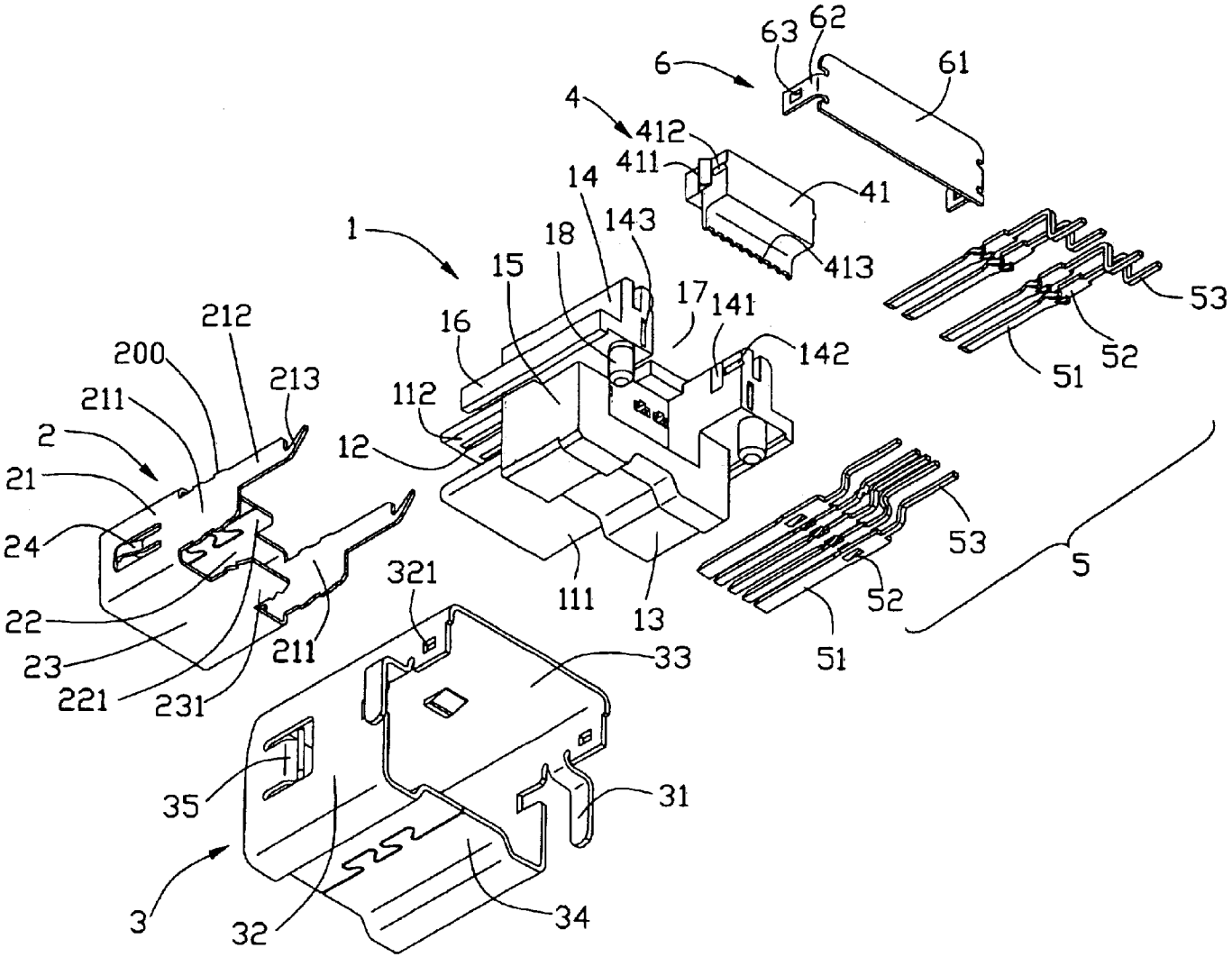
FIG. 3 is an exploded, perspective view of the electrical connector of the FIG. 1.

With reference to FIGS. 1–3, an electrical connector for mounting on a PCB (not shown) comprises an insulative housing 1, a plurality of terminals 5 received in the housing 1, an inner shield 2, an outer shield 3, a spacer 4 and a rear shield 6.

The insulative housing 1 comprises a base portion 13, a first and a second tongues 111,112 extending horizontally and forwardly from the base portion 13. A plurality of passageways 12 are defined in respective inner faces of the first tongue 111 and the second tongue 112 for receiving the corresponding terminals 5 therein. A rib 113 (FIG. 3) is formed at the center of the second tongue 112 and extends toward the first tongue 111 for guiding an insertion of a complementary connector. A frame portion 15 extends from the base portion 13. A pair of first arms 14 project oppositely and upwardly from the frame portion 15, and each defines a vertical slot 141 and a horizontal slot 142 at respective inner faces thereof. A receiving space 17 is defined between the first arms 14 for receiving the spacer 4. A pair of slits 143 extend forwardly from rear ends of the first arms 14 through the base portion 13. The first arms 14 each have a post 18 projecting from a bottom face thereof. A pair of second arms 16 extend outwardly from the opposite sides of the frame portion 15.

The terminals 5 are arranged in an upper and lower rows. Each terminal 5 comprises a contacting portion 51 for electrically engaging with corresponding terminals of the complementary connector, a retention portion 52 extending rearwardly from the contacting portion 51 for retaining the terminal 5 in the corresponding passageways 12 of the housing 1, and an engaging portion 53 extending rearwardly from the retention portion 52 for soldering on the PCB.

The inner shield 2 and the outer shield 3 are respectively stamped from a piece of metal sheet. The inner shield 2 comprises a pair of side walls 21, a top wall 22 and a bottom wall 23. The side walls 21, the top wall 22 and the bottom wall 23 each comprise a retaining plate 211, 221, 231 extending rearwardly therefrom, and a plurality of protrusions 200 formed on the retaining plates 211,221,231 for firmly securing the inner shield 2 on the housing 1. A pair of tabs 24 extend outwardly from the side walls 21. A pair of tail portions 212 extend rearwardly from the retaining plate 211 of the opposite side walls 21 to be received in the corresponding slits 143 of the first arms 14. Distal ends of the tail portions 212 each comprise a slantwise finger 213 extending rearwardly.

The outside shield 3 comprises a pair of side walls 32, a top wall 33 and a bottom wall 34. A pair of lock holes 321 are respectively defined at rear ends of the side walls 32, which are adjacent to the top wall 33. A pair of grounding plates 31 extend downwardly from the side walls 32. The outer shield 3 comprises a pair of spring pads 35 in the side walls 32. The spring pads 35 and the tabs 24 are configuerd to electrically connect with corresponding part of the mating complementary connector and guide the mating complementary connector in its proper position.

The spacer 4 comprises a rectangular base 41 and a first and a second locking blocks 411,412 extending from each of opposite sides of the base 41. The first lock block 411 is formed for engaging with the vertical slot 141 of the first arm 14, and the second lock block 412 is formed for mating with the horizontal slot 142, so that the spacer 4 is reliably positioned in the receiving space 17. The base 41 of the spacer 4 has a plurality of projections 413 formed at a bottom edge thereof for positioning the engaging portions 53 of the terminals 5.

The rear shield 6 comprises a planar main body 61, a pair of retention arms 62 extending from opposite ends of the main body 61 and a. lock tab 63 formed on each retention arm 62. The lock tabs 63 are configured to be received in the lock holes 321 of the outer shield 3 to assemble the rear shield 6 with the outer shield 3.

Figure 4:
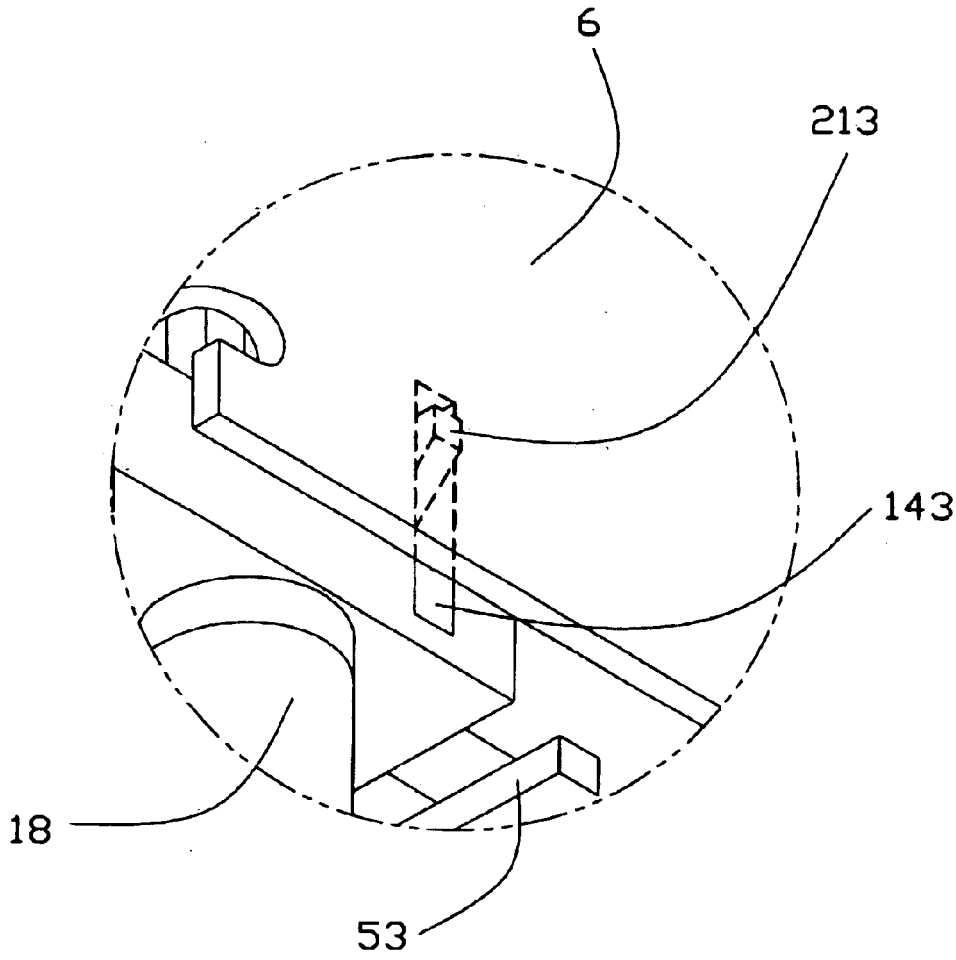
FIG. 4 is a partial enlarged view of the electrical connector show in FIG. 1.

During assembly, the terminals 5 are assembled into the insulative housing 1 from the rear end to the front end of the insulative housing 1. A first space 7 is defined between the tongues 111,112 and the side walls 21 of the inner shield 2 for receiving the complementary connector. The protrusions 200 of the retaining plates 211,231 engage with the insulative housing 1 to retain the inner shield 2 to the housing. The distal ends of the fingers 213 extend rearwardly to the rear faces of the first arms 14. The spacer 4 is inserted into the receiving space 17. The engaging portions 53 of the terminals 5 are positioned between the projections 413 of the spacer 4. The outer shield 3 is assembled to the insulative housing 1 with the bottom wall 34 of the outer shield 3 abutting against the frame portion 15 of the insulative housing 1 and encloses the base portion 13, and defines a second space 8 outside the inner shield 2. The tabs 24 of the inner shield 2 extend partialy received into the second space 8. With reference to FIG. 4, the rear shield 6 is assembled to the outer shield 3 with the main body 61 thereof exactly contacting with the fingers 213 to thereby establish an electrical connection between the inner shield 2 and the outer shield 3, and the inner shield 2 electrically connects to the grounding pads of the PCB through the grounding plates 31 of the outer shield 3.

With reference to FIG. 1, when the connector is mounted on a cutout of the PCB, the second arms 16 of the insulative housing 1 support for supporting the connector on the PCB and the posts 18 are plugged into corresponding holes on the PCB for positioning the connector on PCB.

Because the outer shield 3 and the inner shield 2 are electrically engaged with each other through the rear shield 6 and the outer shield 3 has the grounding plate 31 electrically connecting to the grounding circuits of the PCB, the inner shield 2 do not need grounding plate as compared with the prior art. Therefore, the manufacture of the connector is simplified and the number of the grounding pads of the PCB are decreased.

It is to be understood, however, that even though numerous characteristics and advantages of the present invention have been set forth in the forgoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

an insulative housing comprising a base portion, a pair of tongues extending forwardly from the base portion and a plurality of passageways defined in the tongues;

a plurality of terminals received in the passageways;

an inner metal shield enclosing the tongues of the insulative housing;

an outer metal shield substantially enclosing the insulative housing and being separated from thee inner metal shield by the insulative housing; and a third metal shied electrically connecting the inner metal shield and the outer metal shield;

wherein the third shield comprises a planar main body, a pair of retention arms extending from opposite ends of the main body and a lock portion on each retention arm, and wherein the outer shield defines a pair of lock holes receiving the lock portions of the third shield;

wherein the inner shield comprises a pair of arms extending rearwardly therefrom, each arm having a slantwise finger contacting the planar main body of the third shield;

wherein the inner shield comprises a pair of side walls, a top wall, a bottom wall and a plurality of retaining plates extending rearwardly from the side walls, the top wall and the bottom wall, respectively, the retaining plates being retained onto the base portion of the housing;

wherein the insulative housing comprises a pair of arms extending from the base portion and defines a space between the pair of arms;

further comprising a spacer received in the space of the insulative housing, the spacer comprising a plurality of projections downwardly extending and arranging the terminals;

wherein the pair of arms of the insulative housing each define a vertical slot and a trivial slot, and wherein the base of the spacer comprises a pair of lock blocks on opposite sides thereof engaged within the vertical slots of the insulative housing;

wherein the insulative housing comprises a pair of slits on the arms thereof and the fingers of the inner shield extend into the corresponding slits;

wherein the outer shield comprises at least one grounding plate extending therefrom;

wherein each terminal comprises a contacting portion, a retention portion extending from the contacting portion and an engaging portion connecting to the retention portion.

* * * * *